US008496349B2

(12) United States Patent
Wu et al.

(10) Patent No.: US 8,496,349 B2
(45) Date of Patent: Jul. 30, 2013

(54) UNIFORM LIGHT EMITTING LAMP STRUCTURE

(75) Inventors: Chih-Hsien Wu, Taipei County (TW); Sen-Yuh Tsai, Taipei County (TW)

(73) Assignee: Unity Opto Technology Co., Ltd., Taipei County (TW)

( * ) Notice: Subject to any disclaimer, the term of this patent is extended or adjusted under 35 U.S.C. 154(b) by 332 days.

(21) Appl. No.: 12/984,040

(22) Filed: Jan. 4, 2011

(65) Prior Publication Data

US 2012/0169204 A1 Jul. 5, 2012

(51) Int. Cl.
*F21V 5/00* (2006.01)

(52) U.S. Cl.
USPC . 362/249.02; 362/235; 362/308; 362/311.02; 362/327

(58) Field of Classification Search
USPC ..... 313/111; 362/235, 245, 249.02, 362/307–310, 311.02, 311.07, 311.09, 311.1, 362/327, 329, 363, 555
See application file for complete search history.

(56) References Cited

U.S. PATENT DOCUMENTS

| | | | | |
|---|---|---|---|---|
| 5,865,529 | A * | 2/1999 | Yan | 362/327 |
| 6,803,607 | B1 * | 10/2004 | Chan et al. | 257/98 |
| 2002/0089849 | A1 * | 7/2002 | Lamke et al. | 362/241 |
| 2009/0067179 | A1 * | 3/2009 | Chaves et al. | 362/329 |
| 2012/0098404 | A1 * | 4/2012 | Kaandorp et al. | 313/114 |

* cited by examiner

*Primary Examiner* — Nimeshkumar Patel
*Assistant Examiner* — Steven Horikoshi
(74) *Attorney, Agent, or Firm* — Rosenberg, Klein & Lee

(57) ABSTRACT

The present invention discloses a uniform light emitting lamp structure including a lamp holder, an electric connection portion and a planar portion disposed on both end surfaces of the lamp holder respectively, and the planar portion includes a circuit board electrically coupled to the electric connection portion. The lamp structure further includes an LED light source, a lamp cover and a light guide column with a refractive index $n_1$. After the light of the LED light source is projected from an environmental medium with a refractive index $n_2$ to the light guide column, a portion of the light is reflected from the critical plane in a direction corresponding to the lamp holder through reflections and refractions, such that the light of the LED light source is projected in the environmental medium to achieve the uniform light emitting effect.

5 Claims, 10 Drawing Sheets

UNIFORM LIGHT EMITTING LAMP STRUCTURE

BACKGROUND OF THE INVENTION

1. Field of the Invention

The present invention relates to the field of illumination devices, and more particularly to an uniform light emitting lamp structure that increases an angle of illumination by using a light guide column to achieve a uniform light emitting effect.

2. Description of the Related Art

In a light emitting diode (LED), a positive voltage is applied to an LED chip to emit monochromic discrete light, and the light of a desired wavelength can be emitted by the LED if the chemical composition of the LED chip is changed appropriately. In particular, after white LED was introduced, the LED is used extensively in illumination devices. With the advantages incomparable by traditional light sources, the LED is driven by a lower voltage (5V~24V) to emit light, and thus it can achieve a power saving effect. Under an appropriate application environment or with a good heat dissipation system, the LED has a much longer using life (up to 35,000~50,000 hours) than the traditional light sources and will not cause mercury pollutions as the traditional light sources do.

Since an LED light source is a concentrated light source with a small light emitting angle, the LED requires a special design for providing an adequate illumination angle or range. With reference to FIG. 1 for a schematic structural view of a conventional LED bulb available in the market, the LED bulb 10 comprises a lamp holder 11, an electric connection portion 111 and a planar portion 112 disposed on both end surfaces of the lamp holder 11 respectively, a circuit board 12 installed on the planar portion 112 and electrically coupled to the electric connection portion 111, an LED light source 13 arranged on the circuit board 12, and a lamp cover 14 is installed at the periphery of the planar portion 112 for covering the circuit board 12 and the LED light source 13. In general, the LED light source 13 adopts a high-power LED chip, and a large quantity of heat will be generated after the high-power LED chip is driven to emit light, so that the lamp holder 11 is usually made of a highly thermal conductive material such as aluminum in order to dissipate the heat generated by the LED light source 13 and prevent the brightness of the LED light source 13 from being affected by the heat or the life span of the LED from being shortened.

After being affected by the concentrated illumination effect of the LED light source 13 and installed at the planar portion 112, the light of the LED light source 13 will be projected in the same direction of the planar portion 112. Therefore, a general LED bulb 10 usually has the problem of a non-uniform light emission caused by an insufficient illumination angle of the LED light source 13; particularly, the brightness of lateral lights will drop significantly or even the problem of producing a showdown arises, since the light is blocked by the lamp holder 11.

In view of the shortcomings of the conventional LED bulb, the inventor of the present invention provides a lamp structure capable of achieving a uniform light emitting effect, and the lamp structure uses a light guide column and an environmental medium of different refractive indexes, and wraps and installs an LED light source into the light guide column, and the light guide column has a critical plane on an end surface, such that after the light of the LED light source is incident into the light guide column from the environmental medium, a portion of light is exited from the critical plane of the light guide column through a refraction and a reflection, and a uniform light emitting effect can be achieved when the light of the LED light source is exited from the light guide column and entered into the environmental medium.

SUMMARY OF THE INVENTION

Therefore, it is a primary objective of the invention to provide a uniform light emitting lamp structure making use of different refractive indexes of a light guide column and an environmental medium to change a light emitting path, such that a portion of the light is emitted with an angle to a rear side of a lamp holder, and the lamp structure has a uniform light emitting effect.

To achieve the foregoing objective, the present invention provides a uniform light emitting lamp structure comprising a lamp holder, an electric connection portion and a planar portion disposed on both end surfaces of the lamp holder respectively, a circuit board installed on the planar portion, and electrically coupled to the electric connection portion, and the lamp structure further comprising an LED light source, including a first light source, arranged at a central position of the circuit board; a lamp cover, installed at the periphery of the planar portion of the lamp holder for covering the LED light source; and a light guide column, being a column structure with a refractive index $n_1$, and having a critical plane and a containing portion disposed on both end surfaces of the light guide column, and the containing portion being provided for covering the first light source. To increase the range of the light reflection angle of the present invention, the critical plane is concavely formed in the main body of the light guide column and has a circular conical surface of a predetermined included angle, wherein the predetermined included angle is greater than or equal to 90 degrees, or the critical plane has a circular arc surface concavely formed in the main body of the light guide column, such that when the light passes through the critical plane, the range of the light reflecting angle becomes wider.

In a preferred embodiment, the lamp holder includes a plurality of through holes formed at the periphery of the lamp holder to improve the brightness at a lateral rear side of the lamp holder, such that the light exited from the light guide column to the environmental medium can be passed through the through holes to increase the brightness.

After the first light source is driven to emit light, the light emitted from the first light source will be incident at the light guide column through an environmental medium of a refractive index $n_2$, a portion of light will be refracted and reflected into the light guide column due to the different refractive indexes of the light guide column and the environmental medium, and reflected from the critical plane in a direction corresponding to the lamp holder and then exited from the environmental medium again, such that the improved lamp structure of the present invention can project light towards the front and lateral sides and even a portion of the light can be projected towards the rear side of the lamp holder to achieve the uniform light emitting effect.

Another objective of the present invention is to provide a uniform light emitting lamp structure using a light guide column with a plurality of support wings to guide and emit light at an angle towards the rear side of a lamp holder, and a plurality of second light sources is arranged alternately in the gaps among the support wings to provide the uniform light emitting effect of the lamp.

To achieve the foregoing objective, the uniform light emitting lamp structure further comprises a plurality of support wings installed on the critical plane and distributed radially outward, and each support wing has a light exit plane at an end of the support wing, and the light exit planes are disposed in a direction corresponding to the lamp holder. To improve the light exit effect at the front side of the improved lamp structure, the LED light source further comprises: a second light source, surrounding the first light source and installed on the circuit board, and installed alternately with the positions of the support wings, such that the light emitted from the second light source will not be blocked by the support wings, and the light of the second light source becomes a main light source that emits light from the front side.

In a preferred embodiment, the lamp holder includes a plurality of through holes formed at the periphery of the lamp holder to improve the brightness at the lateral rear side of the lamp holder, such that the light exited from the light exit plane at the end of the support wings of the light guide column to the environmental medium can be passed through the through holes to improve the brightness.

DETAILED DESCRIPTION OF THE PREFERRED EMBODIMENTS

Figure 1:
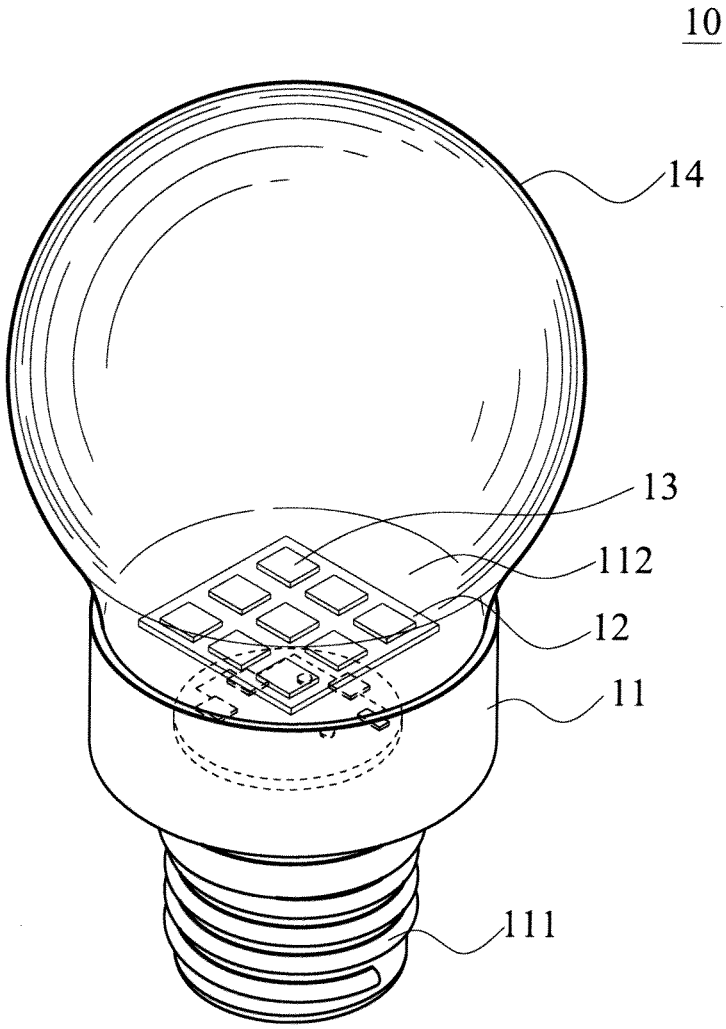
Fig. 1(PRIOR ART)
FIG. 1 is a schematic structural view of a conventional LED bulb.
Figure 2:
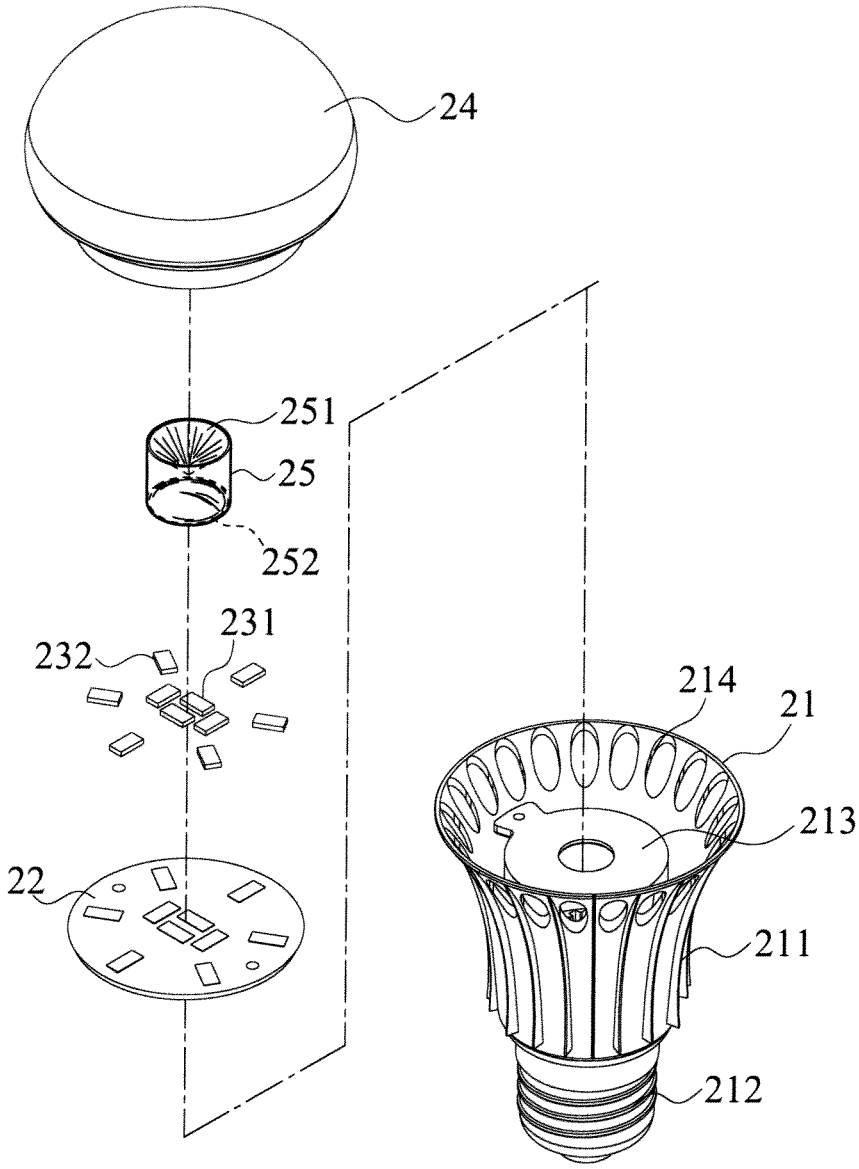
FIG. 2 is a perspective exploded view of a preferred embodiment of the present invention.
Figure 3:
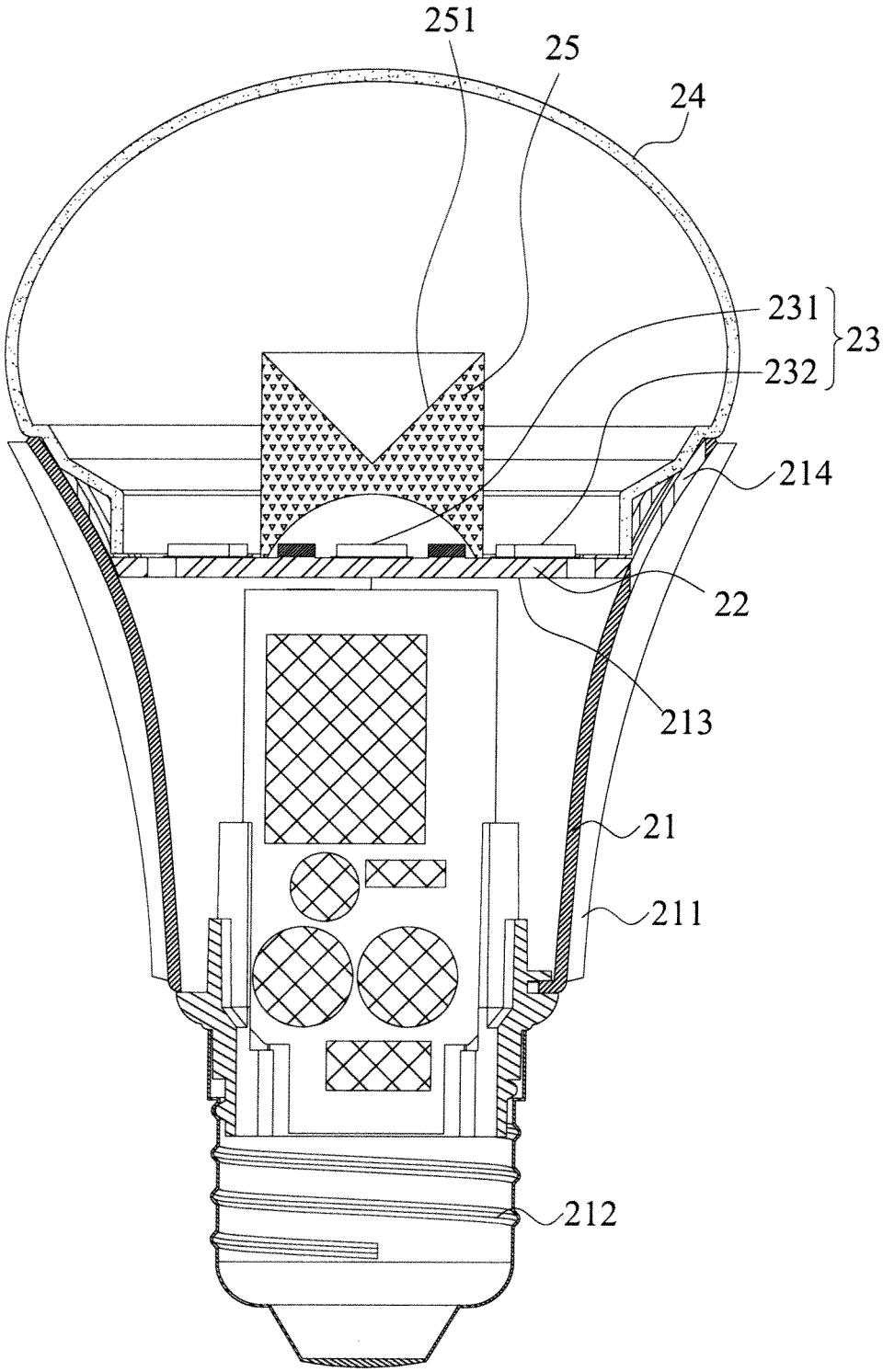
FIG. 3 is a cross-sectional view of a preferred embodiment of the present invention.

The assembly and overall operation method of the present invention to achieve the foregoing objectives and effects will become apparent with the detailed description of preferred embodiments together with related drawings as follows:

With reference to FIGS. 2 and 3 for an exploded view and a cross-sectional view of a lamp structure in accordance with a preferred embodiment of the present invention respectively, the lamp structure 20 comprises a lamp holder 21, a circuit board 22, an LED light source 23, a lamp cover 24 and a light guide column 25.

The lamp holder 21 is a circular cylindrical structure made of aluminum, whose surface includes a plurality of ribs 211 provided for dissipating heat, and an electric connection portion 212 and a planar portion 213 are disposed on both end surfaces of the lamp holder 21 respectively. In addition, the electric connection portion 212 is in the shape of a screw thread, a guide column or an insert pin. Further, the lamp holder 21 includes a plurality of through holes 214 formed at the periphery of the lamp holder 21, and the through holes 214 are formed between the ribs 211, such that the direction of the through holes 214 is parallel to the direction of the ribs 211.

The circuit board 22 is installed on the planar portion 213 of the lamp holder 21 and electrically coupled to the electric connection portion 212 of the lamp holder 21.

The LED light source 23 further includes a first light source 231 formed by a plurality of LED chips and arranged at a central position of the circuit board 22.

The lamp cover 24 made of a transparent material is a hemispherical cover fixed at the periphery of the planar portion 213 of the lamp holder 21 for covering the LED light source 23 and the circuit board 22, and the fixing method includes, but not limited to a latch connection method or an adhesion method.

The light guide column 25 is a column structure of a refractive index $n_1$, and the light guide column 25 includes a critical plane 251 and a containing portion 252 disposed on both end surfaces of the light guide column 25, wherein the containing portion 252 is made in a shape of concave groove for wrapping the first light source 231.

Figure 4:
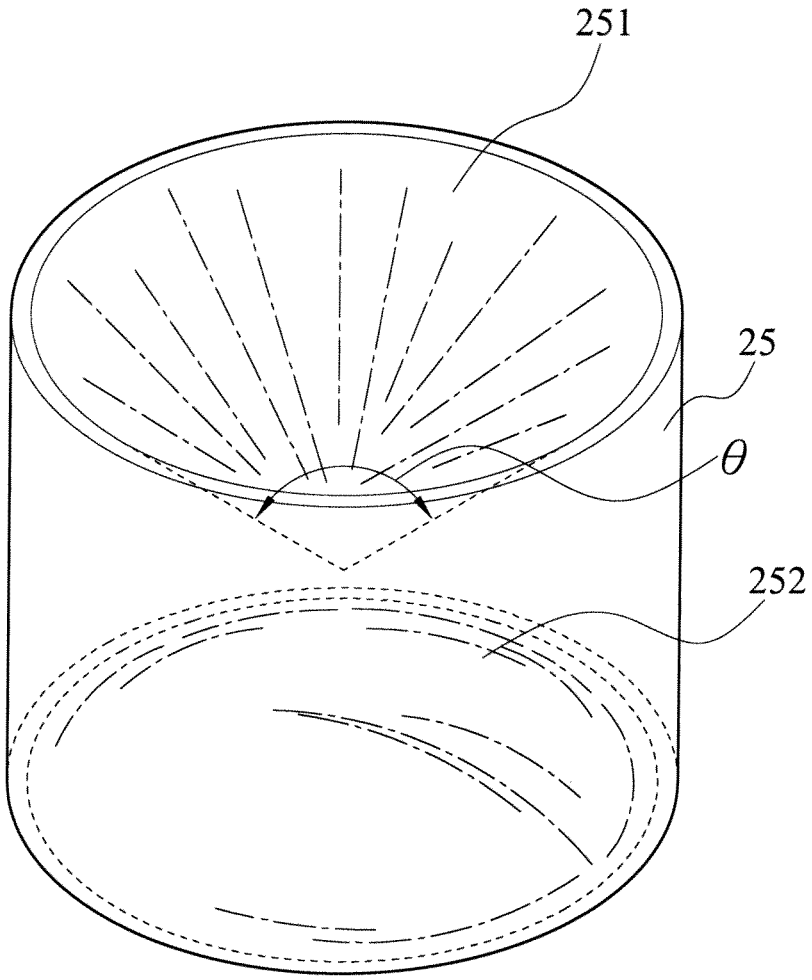
FIG. 4 is a schematic view of a light guide column of a first preferred embodiment of the present invention.
Figure 5:
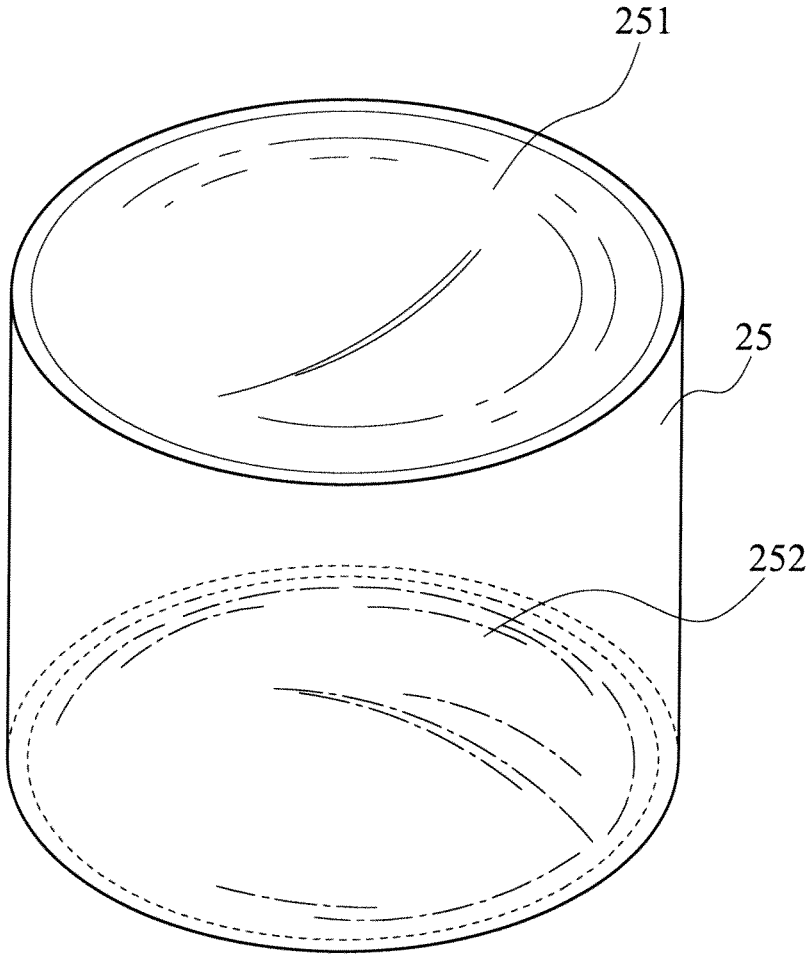
FIG. 5 is a schematic view of a light guide column of a second preferred embodiment of the present invention.

With reference to FIGS. 4 and 5 for preferred embodiments of a light guide column in accordance with a preferred embodiment of the present invention, the light guide column 25 as shown in FIG. 4 is a column structure, wherein the critical plane 251 at the top surface of the light guide column 25 is a circular conical surface concavely formed with a predetermined included angle θ in the main body of the light guide column 25, wherein the predetermined included angle θ is greater than or equal to 90 degrees, and the containing portion 252 at the bottom is also an inwardly concave groove. In FIG. 5, the critical plane 251 is a circular arc surface is concavely formed in the main body of the light guide column 25, such that the light can be reflected by the foregoing different shaped critical planes 251 of the light guide column 25.

Figure 6:
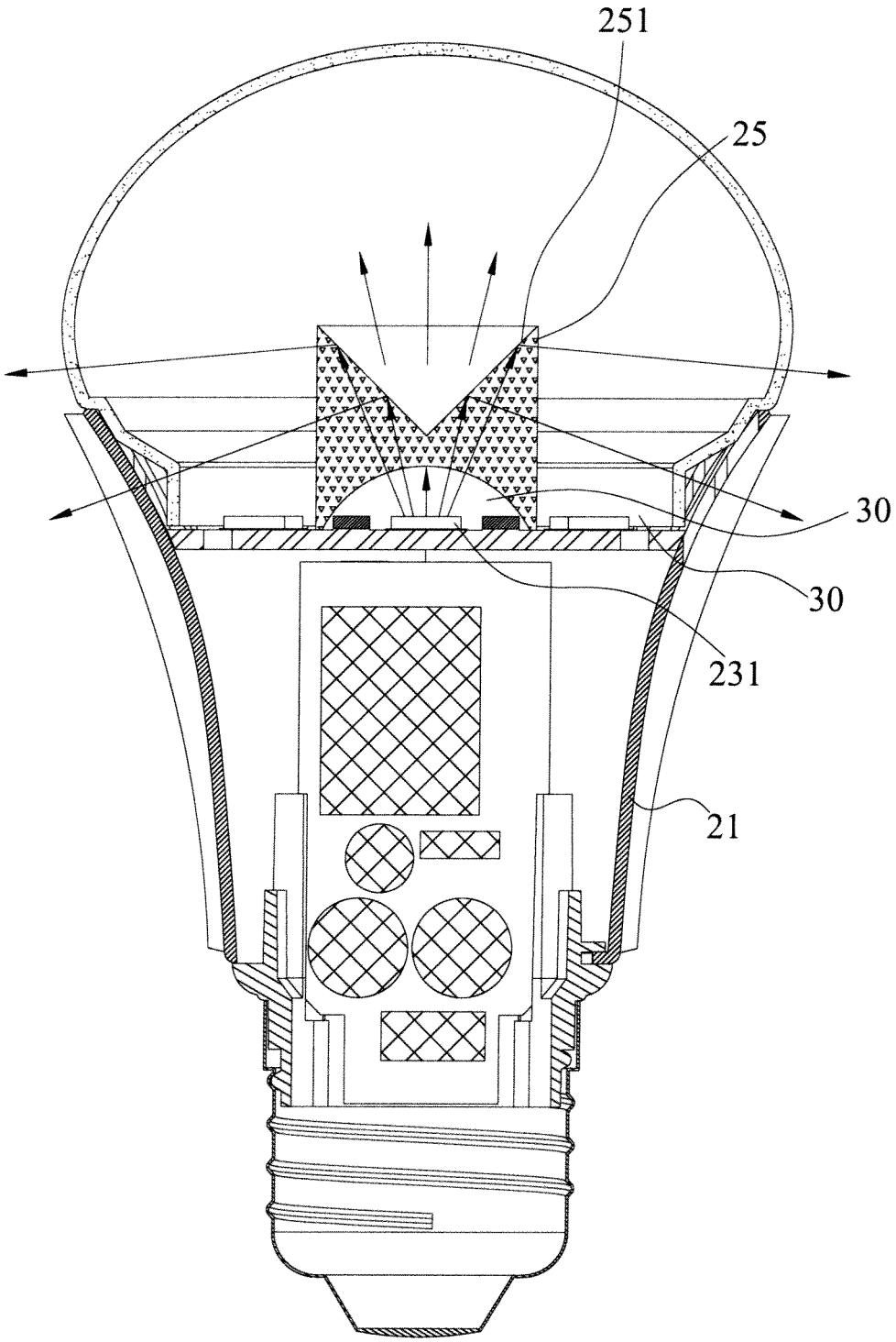
FIG. 6 is a schematic view of an operating state of the light guide column as depicted in FIG. 4.
Figure 7:
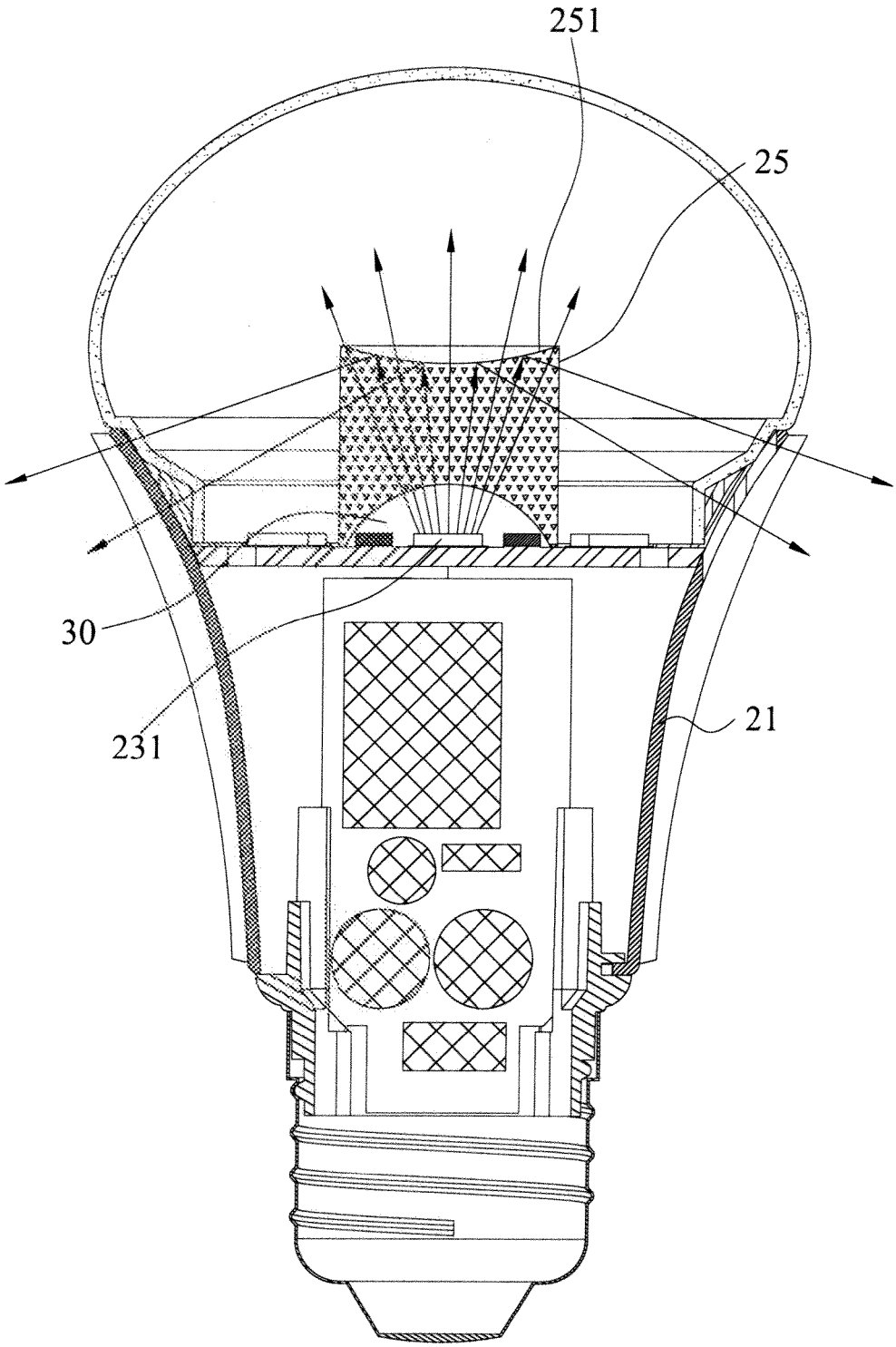
FIG. 7 is a schematic view of an operating state of the light guide column as depicted in FIG. 5.

With reference to FIGS. 6 and 7 for schematic views of applications of the light guide column as depicted in FIGS. 4 and 5 respectively, after the first light source 231 is driven to emit light, the light emitted by the first light source 231 is incident at the light guide column 25 from an environmental medium 30 of a refractive index $n_2$. Since the light guide column 25 and the environmental medium 30 have different refractive indexes, a portion of the light is refracted and reflected in the light guide column 25, and reflected from the critical plane 251 in a direction corresponding to the lamp holder 21 and exited into the environmental medium 30, such that when the lamp structure 20 of the present invention is used for emitting light, the light will be emitted to the front and lateral sides of the lamp holder 21, or even a portion of the light is emitted towards the lateral rear side of the lamp holder 21, so as to achieve the uniform light emitting effect.

Figure 8:
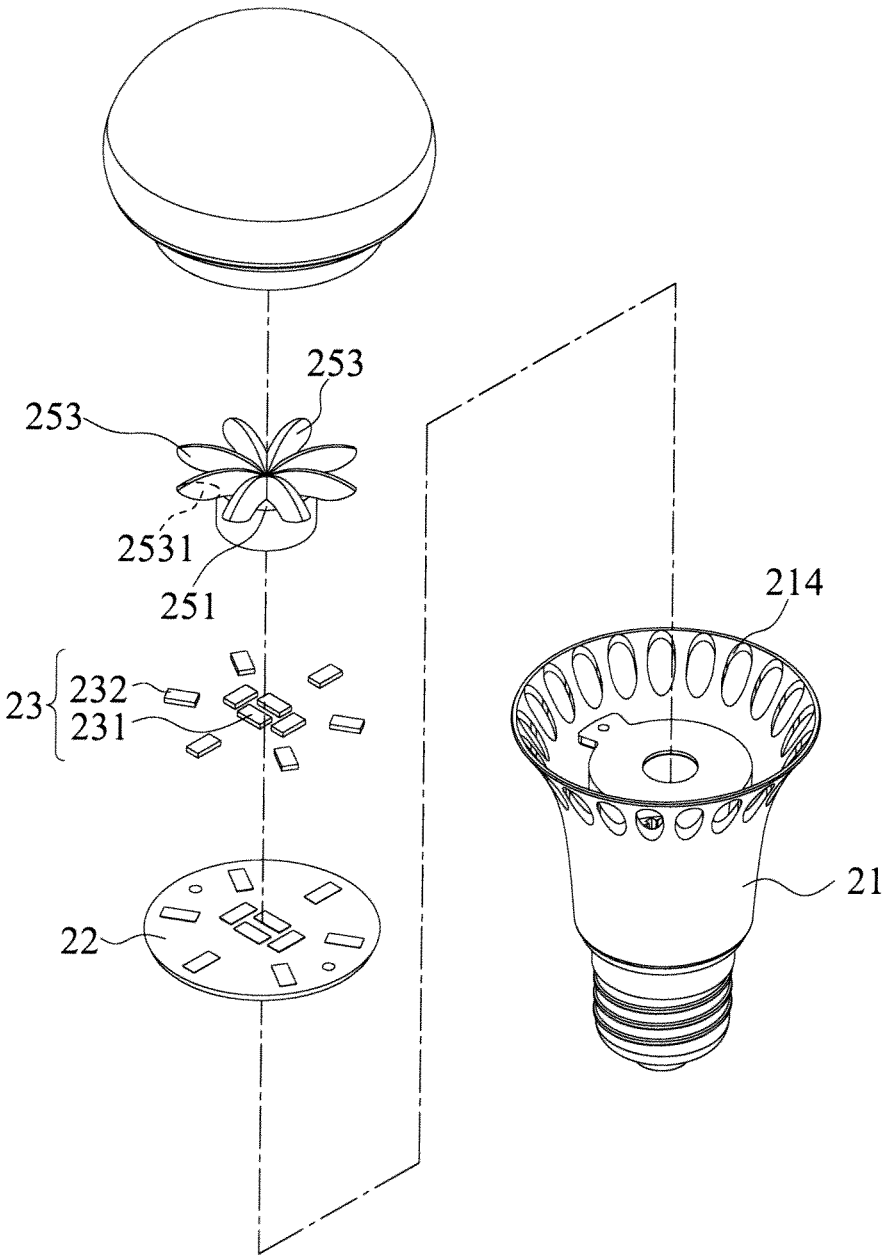
FIG. 8 is a perspective view of another light guide column in accordance with a preferred embodiment of the present invention.
Figure 9:
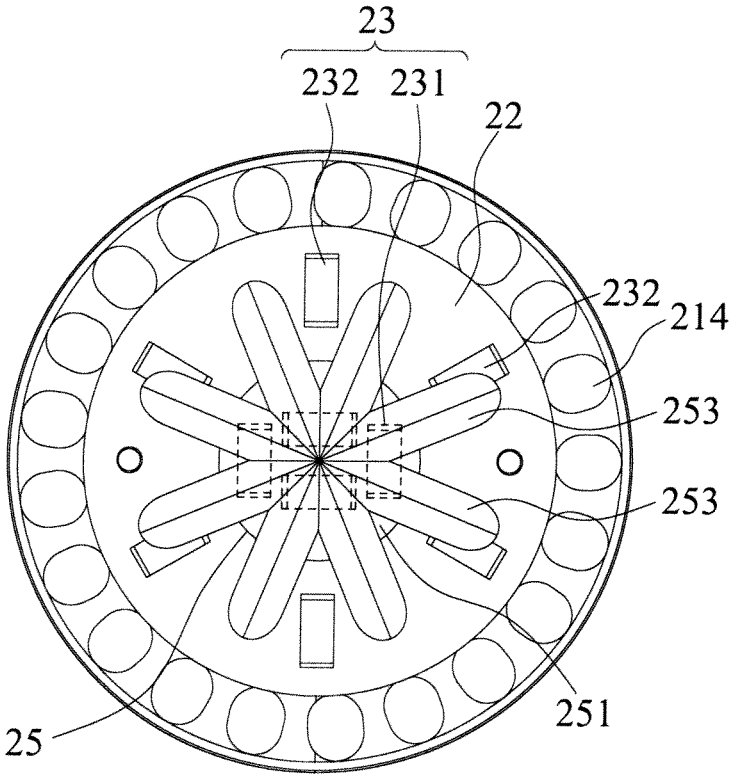
FIG. 9 is a top view of another assembled light guide column in accordance with a preferred embodiment of the present invention.

With reference to FIGS. 8 and 9 for a perspective view of another light guide column and a top view of the assembled light guide column in accordance with a preferred embodiment of the present invention respectively, the lamp structure 20 further comprises: a plurality of support wings 253, each being a curved column structure made of a light guide material, installed on the critical plane 251 of the light guide column 25 and distributed radially outward. In FIGS. 8 and 9, the critical plane 251 is a plane with a predetermined angle of 180 degrees, and the support wings 253 has a light exit plane 2531 formed at an end of the support wings 253, and the light exit planes 2531 are disposed in a direction corresponding to the lamp holder 21. In addition, the LED light source 23 of the present invention further comprises: a second light source 232 arranged on the circuit board 22, and comprised of a plurality of LED chips installed around the second light source 232, wherein the second light source 232 surrounds the exterior of the first light source 231, and each LED chip of the second light source 232 is installed alternately with the support wings 253, such that the light emitted from the second light source 232 will not be blocked by the support wings 253, and the light of the second light source 232 is the main light source for emitting light from the front side. It is noteworthy to point out that the light exit plane 2531 of the support wings 253 corresponds to the through holes 214 formed at the periphery of the lamp holder 21 in accordance with a first preferred embodiment to improve the brightness at the lateral rear side of the lamp holder 21.

Figure 10:
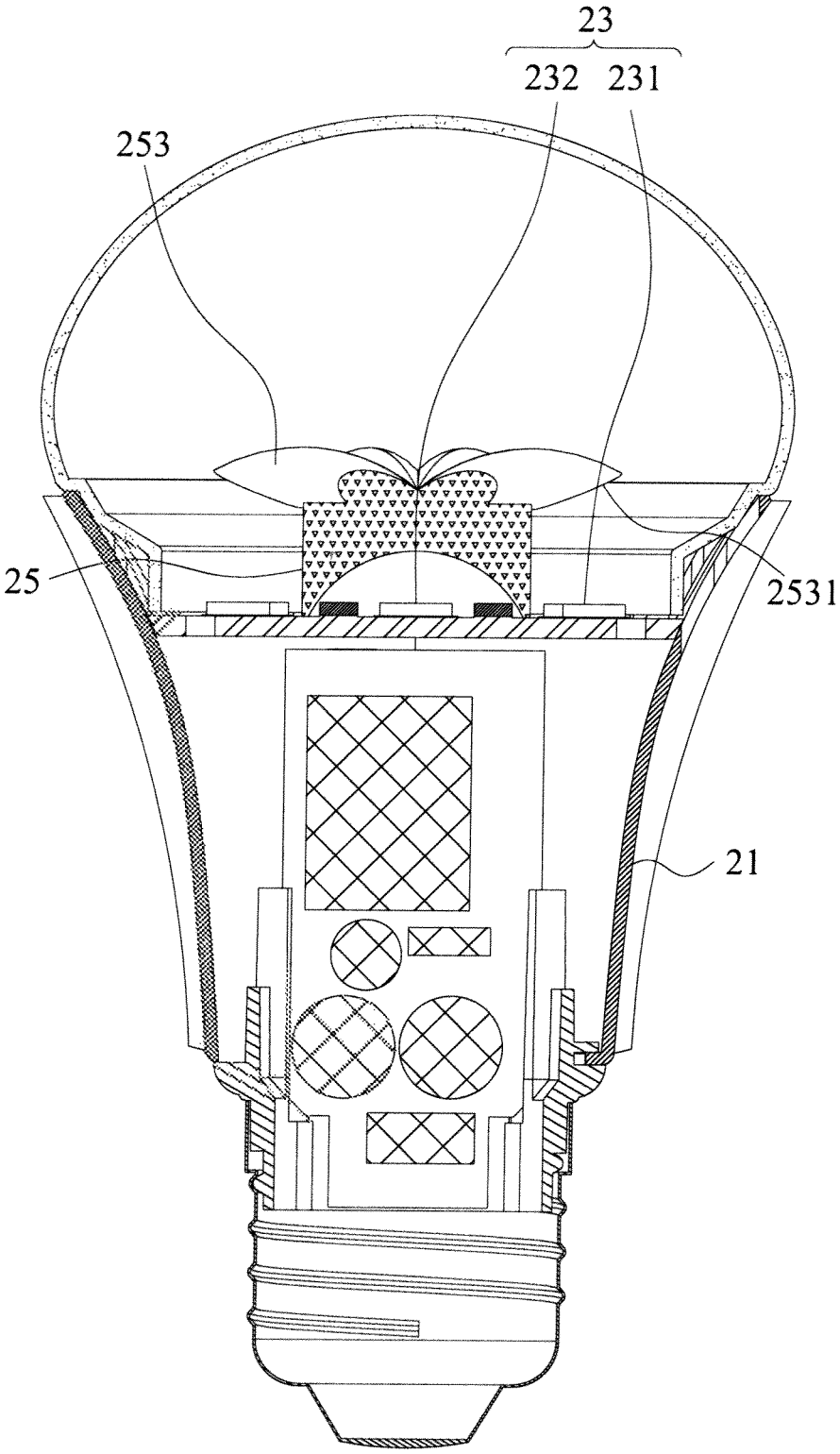
FIG. 10 is a schematic view of using another light guide column in accordance with a preferred embodiment of the present invention.

With reference to FIG. 10 for a schematic view of using another light guide column in accordance with a preferred embodiment of the present invention, the light emitted from the first light source 231 of the LED light source 23 is exited from the light exit plane 2531 at the end of the support wings 253 of the light guide column 25 to the environmental medium 30 and passed through the through holes 214, and the light emitted from the second light source 232 is projected from the gaps among the support wings 253, so as to improve the brightness of the emitted light of each angle and provide a uniform emitted light.

In summation of the description above, the lamp structure 20 of the present invention uses the light guide column 25 and the environmental medium 30 of different refractive indexes to emit light of the LED light source 23 to the light guide column 25 and the environmental medium 30, and after the light of the LED light source 23 is incident from the environmental medium 30 to the light guide column 25, a portion of light is reflected from the critical plane 251 of the light guide column 25 through refractions and reflections to change the angle of projecting the light of the LED light source 23 to the environmental medium, so as to achieve the uniform light emitting effect.

While the invention has been described by device of specific embodiments, numerous modifications and variations such as those of the material, size or shape of the lamp holder, or the form of the electric connection portion, or, the color, power and type of the LED light source, or the material or size of the light guide column could be made thereto by those generally skilled in the art without departing from the scope and spirit of the invention set forth in the claims.

What is claimed is:

1. A uniform light emitting lamp structure, having a lamp holder, an electric connection portion and a planar portion disposed on both end surfaces of the lamp holder respectively, a circuit board installed on the planar portion, and electrically coupled to the electric connection portion, and the lamp structure comprising:

an LED light source, including a first light source, arranged at a central position of the circuit board;

a lamp cover, installed at the periphery of the planar portion of the lamp holder for covering the LED light source;

a light guide column, being a column structure with a refractive index $n_1$, and having a critical plane and a containing portion disposed on both end surfaces of the light guide column, and the containing portion being provided for covering the first light source, such that after a light emitted from the first light source is incident at the light guide column through an environmental medium of a refractive index $n_2$, a portion of the light is exited from the critical plane in a direction corresponding to the lamp holder to the environmental medium through a refraction and a reflection;

wherein the uniform light emitting lamp structure further comprising a plurality of support wings installed on the critical plane and distributed radially outward, and each support wing having a light exit plane at an end of the support wing, and the light exit planes are disposed in a direction corresponding to the lamp holder;

wherein the LED light source further includes a second light source surrounding the first light source and installed on the circuit board; and wherein the second light source is arranged at a position alternately with the support wings, such that the light emitted from the second light source will not be blocked by the support wings.

2. The uniform light emitting lamp structure of claim 1, wherein the lamp holder includes a plurality of through holes formed at the periphery of the lamp holder, such that the light exited from the light guide column to the environmental medium can be passed through the through holes.

3. The uniform light emitting lamp structure of claim 1, wherein the critical plane is concavely and inwardly disposed on the main body of the light guide column, and includes a circular conical surface of a predetermined included angle, and wherein the lamp holder includes a plurality of through holes formed at the periphery of the lamp holder, such that the light exited from the light guide column to the environmental medium can be passed through the through holes.

4. The uniform light emitting lamp structure of claim 3, wherein the predetermined included angle is greater than or equal to 90 degrees, and wherein the lamp holder includes a plurality of through holes formed at the periphery of the lamp holder, such that the light exited from the light guide column to the environmental medium can be passed through the through holes.

5. The uniform light emitting lamp structure of claim 1, wherein the critical plane is a circular arc surface concavely and inwardly disposed on the main body of the light guide column, and wherein the lamp holder includes a plurality of through holes formed at the periphery of the lamp holder, such that the light exited from the light guide column to the environmental medium can be passed through the through holes.

* * * * *